US008645047B2

(12) United States Patent
Daum et al.

(10) Patent No.: US 8,645,047 B2
(45) Date of Patent: Feb. 4, 2014

(54) SYSTEM AND METHOD FOR OPTIMIZING VEHICLE PERFORMANCE IN PRESENCE OF CHANGING OPTIMIZATION PARAMETERS

(75) Inventors: Wolfgang Daum, Erie, PA (US); Glenn Robert Shaffer, Erie, PA (US); Joseph Forrest Noffsinger, Lees Summit, MO (US); Gerald Douglas Rose, Erie, PA (US); Scott Sexauer, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 1524 days.

(21) Appl. No.: 12/245,242

(22) Filed: Oct. 3, 2008

(65) Prior Publication Data

US 2009/0118970 A1 May 7, 2009

Related U.S. Application Data

(60) Provisional application No. 60/985,944, filed on Nov. 6, 2007.

(51) Int. Cl.
*G06F 19/00* (2011.01)

(52) U.S. Cl.
USPC ..... 701/110; 701/1; 701/19

(58) Field of Classification Search
USPC ..... 701/1, 19, 20, 22, 24, 102, 110–112, 701/119; 246/2 R, 122, 125, 167 R, 182 C, 246/187 R, 186
See application file for complete search history.

(56) References Cited

U.S. PATENT DOCUMENTS

| | | | | |
|---|---|---|---|---|
| 5,239,472 | A | 8/1993 | Long et al. | |
| 2007/0219680 | A1 | 9/2007 | Kumar et al. | |
| 2007/0219681 | A1 * | 9/2007 | Kumar et al. | 701/19 |
| 2010/0023190 | A1 * | 1/2010 | Kumar et al. | 701/20 |
| 2013/0131898 | A1 * | 5/2013 | Kumar et al. | 701/20 |

FOREIGN PATENT DOCUMENTS

WO 9003622 A 4/1990

OTHER PUBLICATIONS

Search Report and Written Opinion from corresponding PCT Application No. PCT/US2008/082190 dated Feb. 2, 2009.

* cited by examiner

*Primary Examiner* — John Kwon
(74) *Attorney, Agent, or Firm* — GE Global Patent Operation; John A. Kramer

(57) ABSTRACT

A method for controlling operations of a power system having at least one internal combustion power unit includes: (a) identifying a plurality of discrete potential dynamic events; (b) for each potential dynamic event, computing an optimization profile which describes power settings for the power system to follow in order to optimize at least one operating parameter of the at least one power unit; (c) selecting one of the optimization profiles based on the potential dynamic event with the highest current probability; and (d) operating the system in accordance with the selected optimization profile.

26 Claims, 4 Drawing Sheets

SYSTEM AND METHOD FOR OPTIMIZING VEHICLE PERFORMANCE IN PRESENCE OF CHANGING OPTIMIZATION PARAMETERS

CROSS-REFERENCE TO RELATED APPLICATIONS

This application claims the benefit of Provisional Application 60/985,944 filed on Nov. 6, 2007.

FIELD OF THE INVENTION

This invention relates to optimizing a power system and to monitoring and controlling vehicle operations to improve efficiency while satisfying schedule constraints.

BACKGROUND OF THE INVENTION

Locomotives and other power systems are complex systems with numerous subsystems, with each subsystem being interdependent on other subsystems. An operator is aboard a locomotive to insure the proper operation of the locomotive and its associated load of freight cars. In addition to insuring proper operations of the locomotive, the operator also is responsible for determining operating speeds of the train and forces within the train that the locomotives are part of. To perform this function, the operator generally must have extensive experience with operating the locomotive and various trains over the specified terrain. This knowledge is needed to comply with prescribable operating speeds that may vary with the train location along the track. Moreover, the operator is also responsible for assuring in-train forces remain within acceptable limits.

However, even with knowledge to assure safe operation, the operator cannot usually operate the locomotive so that the fuel consumption is minimized for each trip. For example, other factors that must be considered may include emission output, operator's environmental conditions like noise/vibration, a weighted combination of fuel consumption and emissions output, etc. This is difficult to do since, as an example, the size and loading of trains vary, locomotives and their fuel/emissions characteristics are different, and weather and traffic conditions vary. Operators could more effectively operate a train if they were provided with a means to determine the best way to drive the train on a given day to meet a required schedule (arrival time) while using the least fuel possible, despite sources of variability.

One method for determining the best way to drive an off-highway vehicle or marine vessel or operate a stationary power plant is described in U.S. Patent Application Publication 2007/0225878, entitled "Trip Optimization System and Method for a Train," assigned to the assignee of the present invention. While the method described therein provides for optimal pre-trip planning and continuous updates, there is a need for optimizing vehicle operation in the presence of dynamic events during a trip.

BRIEF DESCRIPTION OF THE INVENTION

These and other shortcomings of the prior art are addressed by the present invention, which provides a method and apparatus for determining power system operation in response to the occurrence of dynamic events. In one embodiment, train or vehicle traffic control objects such as signals and switches become dynamically allocatable speed targets for an automatic train or vehicle operation system, or a throttle fuel optimization system. Changes in the speed allowed at those targets trigger a replan of the speed profile, and the train is then controlled approaching the target within configurable constraints.

According to one aspect of the invention, a method is provided for controlling operations of a power system having at least one internal combustion power unit. The method includes: (a) identifying a plurality of discrete potential dynamic events; (b) for each potential dynamic event, computing an optimization profile which describes power settings for the power system to follow in order to optimize at least one operating parameter of the at least one power unit; (c) selecting one of the optimization profiles based on the potential dynamic event with the highest current probability; and (d) operating the system in accordance with the selected optimization profile.

According to another aspect of the invention, a control system is provided for operating a power system having at least one internal combustion power unit, the control system including: (a) at least one sensor operable to generate signals indicative of at least one operating parameter of the power system; (b) a communications channel operable to deliver data indicative of external information to the control system; and (c) a processor coupled to the at least one sensor and the communications channel, the processor programmed to: (i) identify a plurality of discrete potential dynamic events; (ii) for each potential dynamic event, compute an optimization profile which describes power settings for the power system to follow in order to optimize at least one operating parameter of the at least one power unit; and (iii) select one of the optimization profiles based on the potential dynamic event with the highest current probability It should understood that the principles of the present invention are broadly applicable to any power system which includes a power unit that is used to provide motive power to another component in a vehicle or system. Nonlimiting examples of power systems include trains and other rail vehicles, off highway vehicles, marine vessels and stationary power systems where time varying optimization is performed and the optimization targets may change. As used herein, the term "off-highway vehicle" encompasses vehicles such as mining trucks or other construction or excavation vehicles, agricultural vehicles, and the like. The optimization principles and dynamic control changes described herein can be applied at a system level for electrical or magnetic propulsion, mechanical propulsion, and air or liquid medium pressure propulsion. As used herein, the term "power unit" broadly encompasses devices such as internal combustion (e.g., Diesel) prime movers, battery or capacitor based storage systems, overhead or third rail power sources, wind powered generator systems, wave or hydro powered generator systems, photovoltaic powered generator systems, IR powered generator systems, and the like. The power unit may be internal or external to the power system. For example, an external power unit may move a passive or active vehicle on a guideway. Examples are magnetic levitation trains, cable driven trams and funicular railways, conveyor systems, and air tube systems. Accordingly, it will be understood that, in the subsequent description, references to trains and locomotives are merely representative examples.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
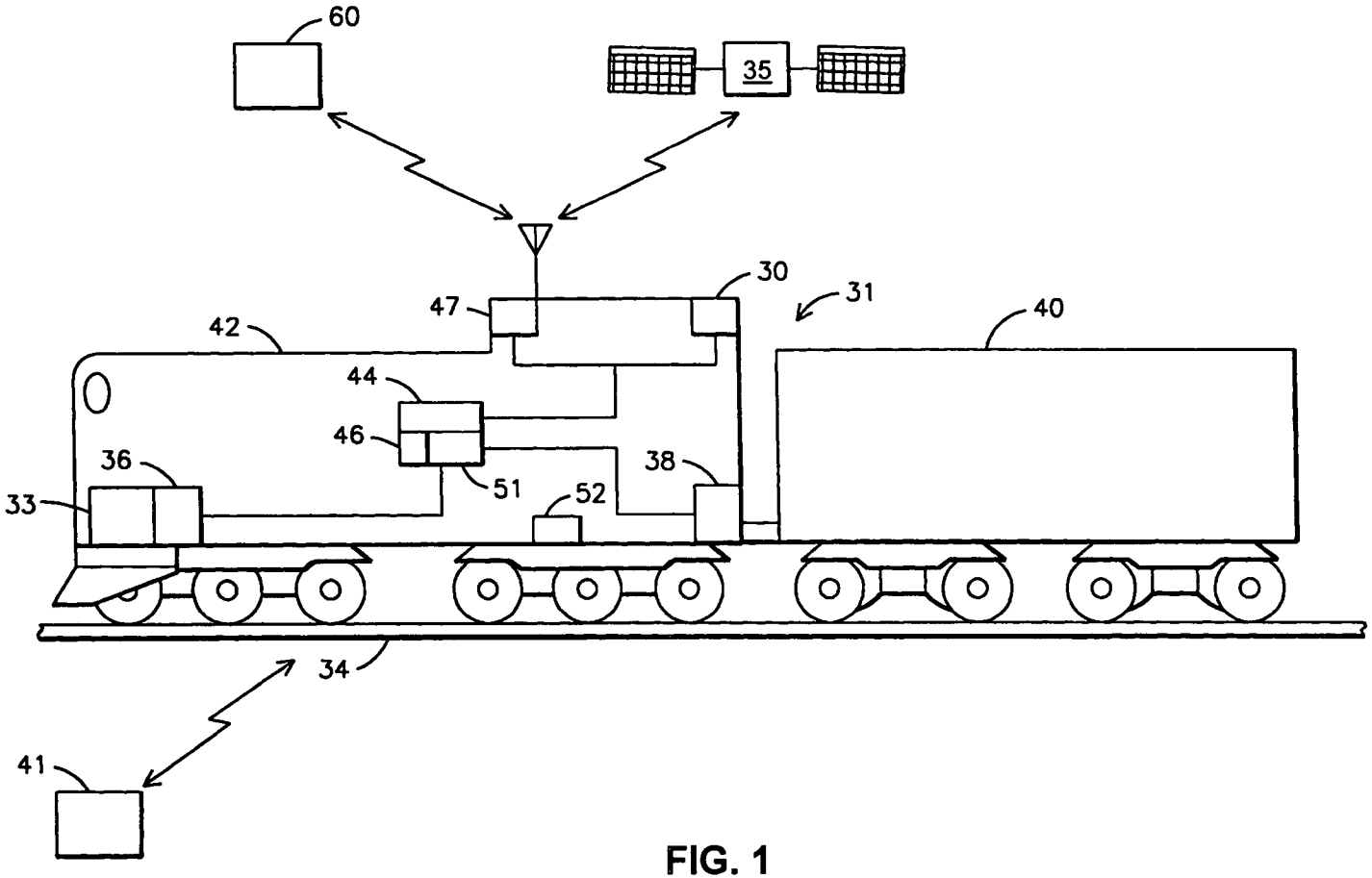
FIG. 1 is a schematic view of a train incorporating apparatus for carrying out an example of the method of the present invention.

Referring to the drawings wherein identical reference numerals denote the same elements throughout the various views, exemplary embodiments of the present invention will be described. The invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary train 31 to which the method of the present invention may be applied. Although not shown for illustrative clarity, it will be understood that the train 31 includes an internal combustion power unit that is operable to provide motive power to one or more other components of the train 31 in a known manner. For example it may drive the train's wheels through a mechanical transmission. Commonly, the power unit would be one or more Diesel-cycle engines mounted in the locomotive consist 42 and coupled to one or more generators. The generators are in turn connected to an electrical energy storage system (e.g., batteries) and/or electric traction motors at the train's wheels.

A locator element 30 to determine a location of the train 31 is provided. The locator element 30 can be a sensor associated with a global positioning system 35, or a system of sensors, that determine a location of the train 31. Examples of other systems may include, but are not limited to, wayside devices, such as radio frequency automatic equipment identification (RF AEI) tags, dispatch, and/or video determination. Another system may include the tachometer(s) aboard a locomotive and distance calculations from a reference point. A wireless communication system 47 may also be provided to allow for communications between trains and/or with a remote location, such as a dispatcher. Information about travel locations may also be transferred from other trains.

A track characterization element 33 provides information about a track, principally grade and elevation and curvature information. The track characterization element 33 may include an on-board track integrity database 36. Sensors or data generators 38 are used to measure or estimate a tractive effort 40 being hauled by the locomotive consist 42, a throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered. It is understood that the sensor or tractive effort data generator may be in discrete form or derive the required value based on data from other vehicle parameters. For example, the tractive effort may be derived by measuring the fuel consumed by the prime mover and subtracting the power used by any auxiliary device connected thereto.

FIG. 1 further discloses other elements that may be part of an embodiment of the present invention. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34, as a solution of non-linear differential equations derived from physics with simplifying assumptions that are provided in the algorithm. The algorithm 46 has access to the information from the locator element 30, track characterizing element 33, and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver, driver advisor, and/or controller element 51 is also provided. As discussed herein the controller element 51 is used for controlling the train as it follows the trip plan. In an exemplary embodiment discussed further herein, the controller element 51 makes train operating decisions autonomously. In another exemplary embodiment, a driver or operator may be involved with directing the train to follow the trip plan.

Figure 2:
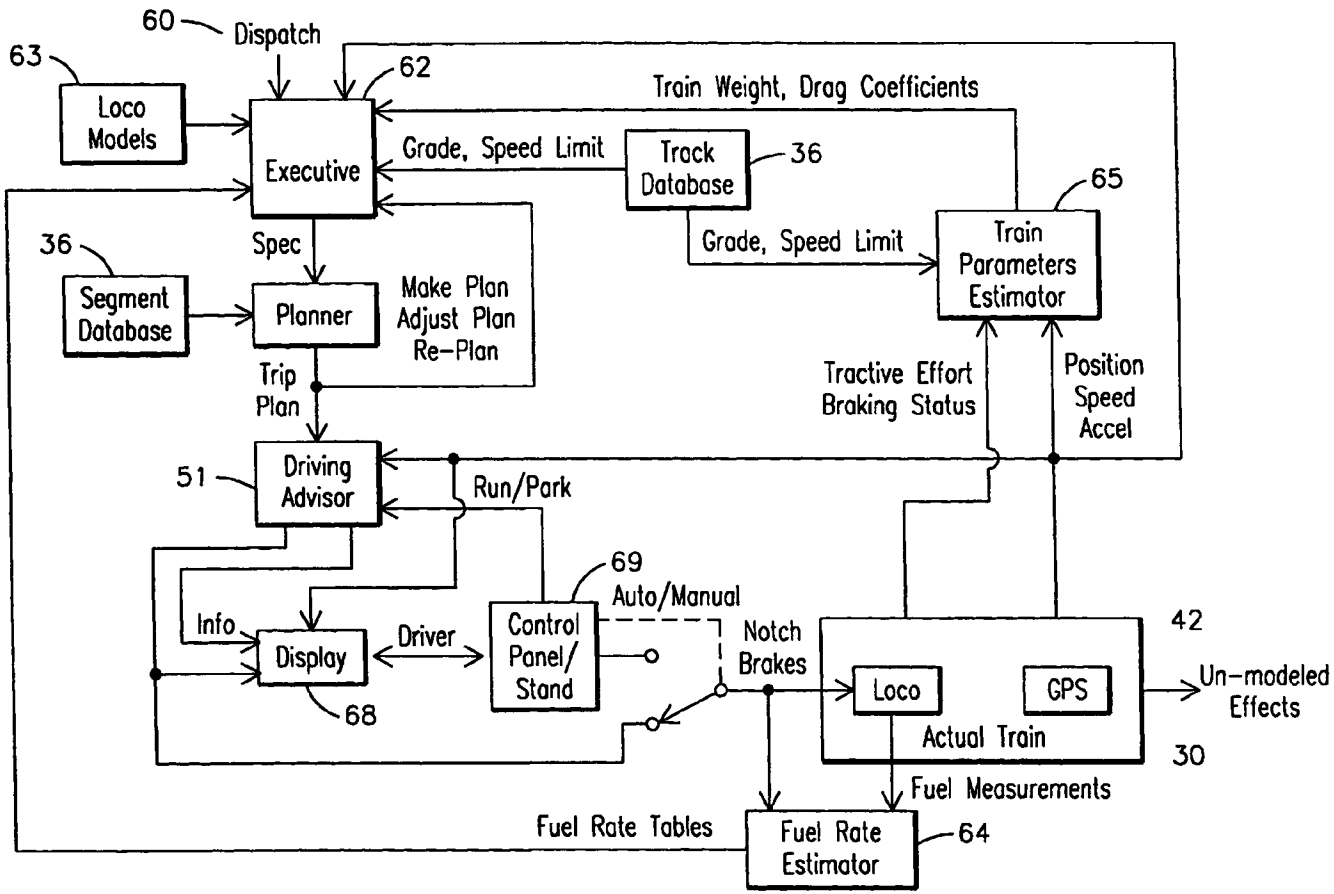
FIG. 2 is a block diagram illustrating the functional components of an embodiment of the present invention.

FIG. 2 depicts a schematic of the functional elements of an embodiment of the present invention. A remote facility, such as a dispatcher 60 (see also FIG. 1) can provide information to the train 31. As illustrated, such information is provided to an executive control element 62. Also supplied to the executive control element 62 is information from a locomotive modeling information database 63 ("Loco Models"), information from a track database 36 ("Segment Database") such as, but not limited to, track grade information and speed limit information, estimated train parameters such as, but not limited to, train weight and drag coefficients, and fuel rate tables from a fuel rate estimator 64. The executive control element 62 supplies information to a planner 12, which is disclosed in more detail in FIG. 3, for preparing a trip plan. (As should be appreciated, the planner 12 may comprise or be part of the processor 44 and algorithm 46 shown in FIG. 1.) Once a trip plan has been calculated, the plan is supplied to a driving advisor, driver, or controller element 51. The trip plan is also supplied to the executive control element 62 so that it can compare the trip when other new data is provided.

As discussed above, the driving advisor or controller element 51 can automatically set a notch power, either a pre-established notch setting or an optimum continuous notch power. In addition to supplying a speed command to the locomotive 31, in the case of a driving advisor 51 that recommends control settings for the operator to follow based on the trip plan, a display 68 is provided so that the operator can view what the planner 12 has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory (e.g., a section of track without signals), or where information from wayside equipment cannot electronically transmit information to a train and instead the operator views visual signals from the wayside equipment, the operator inputs commands based on information contained in track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include but are not limited to, the use of measured gross horsepower and known fuel characteristics to derive the cumulative fuel used.

Figure 3:
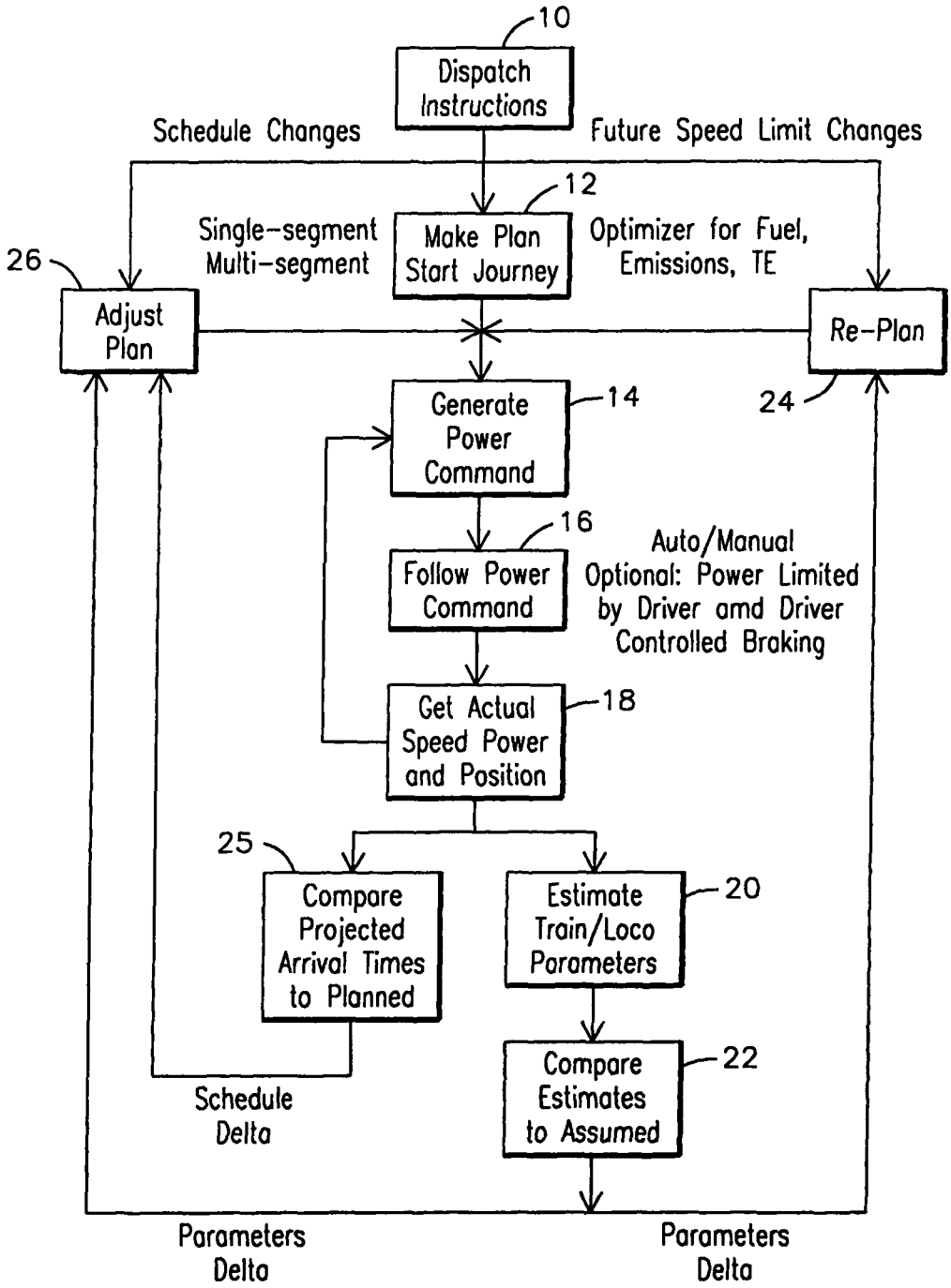
FIG. 3 is a block diagram illustrating a method of train control according to an aspect of the present invention.

The train 31 equipped as described above may be operated according to a trip planning and optimization method described in U.S. Patent Application Publication 2007/0225878 noted above. An example of that method is illustrated in FIG. 3. Instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (effective track grade and curvature as function of milepost or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a hard card and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route, e.g., with altitude, ambient temperature and condition of the rails and railcars. Vehicle efficiency is also affected by other external factors such as differential air pressures encountered in a tunnel. The plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and the operating rules associated with each of the signals. For example, some signals have a single light (on/off), some signals have a single lens with multiple colors, and some signals have multiple lights and colors. These signals can indicate the track is clear and the train may proceed at max allowable speed. They can also indicate a reduced speed or stop is required. This reduced speed may need to be achieved immediately, or at a certain location (e.g., prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the trip planner 12, an optimal plan which minimizes fuel use and/or emissions produced subject to speed limit constraints along the route with desired start and end times is computed to produce a trip profile or plan. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art that the profile provides power settings for the train, either at the train level, consist level, and/or individual train level. The term "power" comprises braking power, motoring power, and/or airbrake power. In another embodiment, instead of operating at the traditional discrete notch power settings, a continuous power setting, determined as optimal for the profile selected, is selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be implemented flexibly to minimize fuel subject to constraints on emissions and speed limits, or to minimize emissions, subject to constraints on fuel use and arrival time. It is also possible to implement, for example, a goal to minimize the total travel time without constraints on total emissions or fuel use where such relaxation of constraints would be permitted or required for the mission.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

Here, x is the position of the train, v its velocity and t is time (in miles, miles per hour, and minutes or hours as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup, and terrain on which the train is located, and R is the net speed dependent drag of the locomotive consist and train combination. The initial and final speeds can also be specified, but without loss of generality are taken to be zero here (e.g., train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be set up flexibly to minimize fuel subject to constraints on emissions and speed limits, or to minimize emissions, subject to constraints on fuel use and arrival time.

It is also possible to implement, for example, a goal to minimize the total travel time without constraints on total emissions or fuel use where such relaxation of constraints would be permitted or required for the mission. All these performance measures can be expressed as a linear combination of any of the following:

$$\min_{u(t)} \int_0^{T_f} F(u(t))dt - \text{Minimize total fuel consumption}$$

$$\min_{u(t)} T_f - \text{Minimize Travel Time}$$

$$\min_{u_i} \sum_{i=2}^{n_d} (u_i - u_{i-1})^2 - \text{Minimize notch jockeying(piecewise constant input)}$$

$$\min_{u(t)} \int_0^{T_f} (du/dt)^2 dt - \text{Minimize notch jockeying(continuous input)}$$

A commonly used and representative objective function is thus $$\min_{u(t)} \alpha_1 \int_0^{T_f} F(u(t))dt + \alpha_3 T_f + \alpha_2 \int_0^{T_f} (du/dt)^2 dt \qquad \text{(OP)}$$

The coefficients of the linear combination will depend on the importance (weight) given for each of the terms. Note that in equation (OP), u(t) is the optimizing variable which is the continuous notch position. If discrete notch is required, e.g., for older locomotives, the solution to equation (OP) would be discretized, which may result in less fuel saving. Finding a minimum time solution ($\alpha_1$ and $\alpha_2$ set to zero) is used to find a lower bound for the achievable travel time ($T_f = T_{fmin}$). In this case, both u(t) and $T_f$ are optimizing variables. In one embodiment, equation (OP) is solved for various values of $T_f$ with $\alpha_3$ set to zero. For those familiar with solutions to such optimal problems, it may be necessary to adjoin constraints, e.g., the speed limits along the path:

$$0 \le v \le SL(x)$$

Or when using minimum time as the objective, that an end point constraint must hold, e.g., total fuel consumed must be less than what is in the tank, e.g., via:

$$0 < \int_0^{T_f} F(u(t))dt \le W_F$$

Here, $W_F$ is the fuel remaining in the tank at $T_f$. Those skilled in the art will readily recognize that equation (OP) can be in other forms as well and that what is presented above is an exemplary equation for use in the present invention.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example, in an exemplary embodiment, suppose a train is traveling a 277 km (172-mile) stretch of track in the southwest United States. Utilizing embodiments of the present invention (e.g., the trip planner 12), an exemplary 7.6% saving in fuel used may be realized when comparing a trip determined and followed using the trip planner 12 versus an actual driver throttle/speed history where the trip was determined by an operator. The improved savings is realized because the optimization realized by using the present invention produces a driving strategy with both less drag loss and little or no braking loss compared to the trip plan of the operator. To make the optimization described above computationally tractable, a simplified mathematical model of the train may be employed.

Referring back to FIG. 3, once a trip plan is created 12 and the trip started, power commands are generated 14 to put the plan in motion. Depending on the operational set-up of the present invention as implemented, one command is for the locomotive to follow the optimized power command 16 so as to achieve the optimal speed. The trip planner 12 obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch and/or the operator requesting a change in objectives to be consistent with more global movement planning objectives. Additional global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

In operation, the locomotive 42 (more specifically, the trip planner 12 on the locomotive) will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. Efficiency trends may also be generated that can be used to develop locomotive fleet data regarding efficiency transfer functions. The fleet-wide data may be used when determining the initial trip plan, and may be used for network-wide optimization tradeoff when considering locations of a plurality of trains.

Many events in daily operations can lead to a need to generate or modify a currently executing plan, where it desired to keep the same trip objectives, for example when a train is not on schedule for a planned meet or pass with another train and it needs to make up time. Using the actual speed, power, and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically according to a railroad company's desire for how such departures from plan should be handled, or alternatives may be manually proposed for the on-board operator and dispatcher to jointly decide the best way to get back on plan. Whenever a plan is updated but where the original objectives (such as but not limited to arrival time) remain the same, additional changes may be factored in concurrently, e.g., new future speed limit changes, which could affect the feasibility of ever recovering the original plan. In such instances, if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such as train operating limits, are exceeded. For example, if the current plan execution is running late by more than a specified threshold, such as thirty minutes, the present invention can re-plan the trip to accommodate the delay at the expense of increased fuel use, as described above, or to alert the operator and dispatcher how much of the time can be made up at all (i.e., what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such as in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g., the dispatch office is required. For example, the coordination of meets and passes may be further optimized through train-to-train communications. Thus, as an example, if a train knows that it is behind schedule in reaching a location for a meet and/or pass, communications from the other train can notify the late train (and/or dispatch). The operator can then enter information pertaining to being late into the system of the present invention, which recalculates the train's trip plan. The system of the present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could be based on either schedule or fuel saving benefits, depending on the situation.

Once a trip plan is created as discussed above, a trajectory of speed and power versus distance is used to reach a destination with minimum fuel use and/or emissions at the required trip time. There are several ways in which to execute the trip plan. As provided below in more detail, in one exemplary embodiment, when in an operator "coaching mode," information is displayed to the operator for the operator to follow to achieve the required power and speed determined according to the optimal trip plan. In this mode, the operating information includes suggested operating conditions that the operator should use. In another exemplary embodiment, acceleration and maintaining a constant speed are autonomously performed. However, when the train 31 must be slowed, the operator is responsible for applying a braking system 52. In another exemplary embodiment, commands for powering and braking are provided as required to follow the desired speed-distance path.

During the trip, regardless of whether the train 31 is operated in accordance with a plan determined prior to departure, it is likely that the train 31 will encounter one or more dynamic events whose existence or exact nature are not known before the trip is started. Examples of such events include, but are not limited to: changing signal aspects, temporary slow orders (TSOs), the presence of other trains on the track, locomotive or other equipment failures, changing track conditions (e.g., bridge failures), derailments, etc.

Conventionally, these events would be accommodated by human intervention, by a supervisory system such as Positive Train Control ("PTC") or Automated Train Operation ("ATO"), or a combination thereof. For example, if the train 31 encounters a restrictive signal such as "approach" or yellow, requiring a reduced speed, because of an upcoming block that is occupied by another train, a supervisory train system may identify the signal as a braking target, compute a braking curve to be enforced to meeting the braking target, and then apply the train's brakes to slow or stop the train 31 as necessary. This can cause excessive in-train forces and partially defeat the efficiency gains provided by the trip planning. Alternatively, a human operator may reduce the throttle ("coast") or apply dynamic braking ahead of a dynamic target, to minimize use of the train (friction) brakes. This requires substantial operator experience and also creates a high operator workload, with associated increased risk of operator error.

Figure 4:
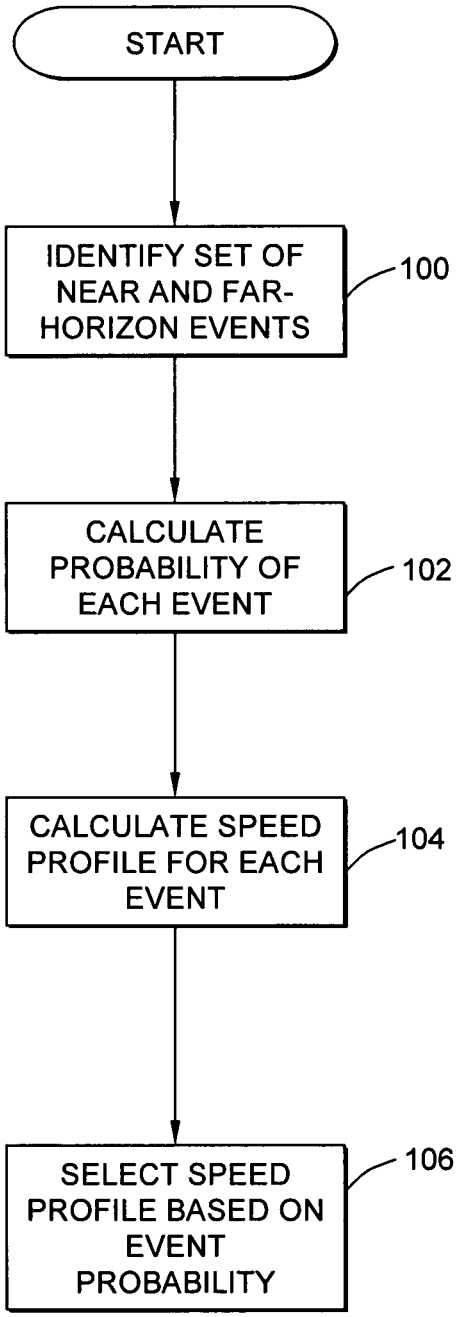
FIG. 4 is a flow chart illustrating a method of optimization according to an aspect of the present invention.

Accordingly, the present invention provides a method for optimizing train operations taking into account dynamic targets. The basic method is described in FIG. 4. First, a plurality of discrete potential dynamic events are identified (block 100). The farther an event is separated from the train 31 in distance or time, the less certain its probability of occurrence is known. This is referred to as a "far-horizon" event. The closer an event is to the train in distance or time, the more certain its probability is known. This is referred to as a "near-horizon" event. Each event may be assigned a probability based on its status as "near-horizon" or "far-horizon" (block 102). As a more specific example, the status of a signal in a nearby upcoming track block may be one of a set number of conditions, such as clear, restricted, or stop, and may be considered a "near-horizon" whereas the status of a signal located many blocks ahead of the train 31 may depend not only on the status of other traffic far ahead of the train 31, but also on whether the train 31 would pass through the distant block after passing through switches and other blocks. This would be a "far-horizon" event. Conventional statistical techniques may be used to assign a probability value to specific events.

Identification of events may be through train-to-train communications, wayside-to-train communications, onboard sensors, track circuits, central dispatch control systems or movement planner to train, or from other onboard system such as Cab Signal, ATP (Automatic Train Protection) or PTC interfaced to an implementation of the present invention, or the like.

For each event, an optimized speed profile is computed (block 104) using the techniques described above with respect to the trip plan. The computation identifies each event as a potential speed/braking target and uses knowledge of the train's current location with respect to the upcoming target, train weight/speed, and track topology, to compute a speed profile both before and after the target. Events having a probability below a predetermined threshold value may be ignored when calculating speed profiles, so as to constrain the set of calculations and avoid overtaxing available computing resources.

The speed profile may be calculated onboard the train 31, or may be calculated offboard and relayed to the train 31 through a communications channel.

For example, a signal in the block ahead of the train 31 may display a "stop" aspect (e.g., a red-colored signal) because it is occupied by another train. The present method would compute a first speed profile using throttle reduction, dynamic braking, or a combination thereof calculated to bring the train 31 to a stop with minimal use of train brakes. A second speed profile would also be calculated based on the possibility that the upcoming block could be vacated, resulting in a signal upgrade to a less restrictive aspect, before train braking is required.

Once all of the constrained set of speed profiles are calculated, one of the speed profiles is chosen based on the event with the highest current probability (block 106). A closed-loop algorithm then performs control of the train's speed approaching the target in accordance with the chosen speed profile, using current train position, track database, locomotive speed, train length, train weight, and consist capability (e.g., tractive HP and braking HP as a function of notch) as inputs. The control may be automatic. If conditions change as the train 31 approaches the target, a different speed profile may be used.

Optionally, an operator may be advised of the appropriate control settings to be manually implemented.

A speed profile is just one example of an optimization profile that can be used to optimize vehicle performance according to the present invention. Nonlimiting examples of parameters that can be optimized and optimization profiles that can be computed include speed, fuel efficiency, emissions (e.g., audio, gaseous, RF, heat, carbon, NOx, particulate matter), vibration, component efficiency, such as catalyst performance, etc., alternate speed other target changes, fuel efficiencies, noise, emissions, etc., or combinations thereof. Operation of some vehicles may be subject to day to night time variations (e.g., noise limits), emission restrictions based on geographic location, etc.

Another embodiment relates to a method for controlling operations of a train having one or more locomotive consists, with each locomotive consist comprising one or more locomotives. (This embodiment is also applicable for controlling other power systems with other power units.) In this embodiment, a plurality of discrete potential dynamic events are identified, each of which has a current probability associated therewith. (By "potential dynamic" event, it is meant an event that may or may not occur and that may change in/over time. "Current" probability refers to a probability at the time the event is identified.) For each potential dynamic event, an optimization profile is computed which describes power settings (including braking) for the train and/or one or more locomotives to follow in order to optimize at least one operating parameter of train and/or one or more locomotives, e.g., for reducing or minimizing fuel use of the train and/or reducing or minimizing emissions produced by the train. One of the optimization profiles is selected for controlling the train and/or locomotives, based on the potential dynamic event with the highest current probability. For calculating each optimization profile, the following steps may be carried out. First, route data and train data is received, e.g., from a database or otherwise. The route data includes data relating to one or more characteristics of a track on which the train is to travel along a route and data relating to at least one speed limit along the route. In this embodiment, the route data also includes data relating to the discreet potential dynamic event for which the optimization profile is being calculated. (The route data may also include data related to the other discreet potential dynamic events.) The train data relates to one or more characteristics of the train. The optimization profile is created on-board the train at any time during travel of the train along the route, e.g., at such a time as the discreet potential dynamic event is identified. The optimization profile is created at a first point along the route based on the received data, and covers at least a segment of the route extending to a second point further along the route than the first point. The optimization profile is created for covering the entirety of the segment based on, and regardless of, all the different geographic features or other characteristics of the route along the segment for which data is available. By this, it is meant: (i) the optimization profile takes into consideration all the different geographic features or other characteristics of the route segment for which data is available, and (ii) the optimization profile is created regardless of what particular geographic features or other characteristics of the route are along the segment. Thus, no matter what known geographic features or other route characteristics are along a route segment, an optimization profile is created for that segment, for the discreet potential dynamic event in question.

While the invention has been described with respect to various embodiments thereof, many variations and modifications will become apparent to those skilled in the art. Accordingly, it is intended that the invention not be limited to the specific illustrative embodiment.

What is claimed is:

1. A method for controlling operations of a power system having at least one power unit, the method comprising:

(a) identifying a plurality of discrete potential dynamic events;

(b) for each potential dynamic event, computing an optimization profile which describes power settings for the power system to follow in order to optimize at least one operating parameter of the at least one power unit;

(c) selecting one of the optimization profiles based on the potential dynamic event with the highest current probability; and (d) operating the system in accordance with the selected optimization profile.

2. The method of claim 1 where the optimization profile is calculated onboard the power system.

3. The method of claim 1 wherein the optimization profile is calculated offboard and relayed to the power system through a communications channel.

4. The method of claim 1 wherein the optimization profile optimizes a parameter selected from the group consisting of: speed, fuel efficiency, vehicle emissions, vibration, component efficiency, geographic restrictions, and combinations thereof.

5. The method of claim 1, wherein the steps of identifying a plurality of potential dynamic events, computing the optimization profiles, selecting one of the optimization profiles, and operating the power system in accordance with the selected optimization profile are performed autonomously.

6. The method of claim 1 wherein the potential dynamic events are classified as near-horizon events or far-horizon events, and wherein near-horizon events are assigned a higher probability than far-horizon events.

7. The method of claim 6 wherein the potential dynamic events are classified as near-horizon events or far-horizon events based on their physical distance from the power system.

8. The method of claim 6 wherein the potential dynamic events are classified as near-horizon events or far-horizon events based on their temporal separation from the power system.

9. The method of claim 1, wherein the power system comprises a railway transportation system, and wherein the power unit comprises at least one locomotive powered by at least one internal combustion engine.

10. The method of claim 1, wherein the power system comprises a marine vessel, and wherein the power unit comprises at least one internal combustion engine.

11. The method of claim 1, wherein the power system comprises an off-highway vehicle, and wherein the power unit comprises at least one internal combustion engine.

12. The method of claim 1, wherein the power system comprises an external power unit which provides motive power to move a passive or active vehicle on a guideway.

13. The method of claim 1, wherein the power system comprises an electrical power generation system.

14. The method of claim 1, wherein at least one of the dynamic events comprises a speed target external to the power system.

15. A control system for operating a power system having at least one internal combustion power unit, the control system comprising:

(a) at least one sensor operable to generate signals indicative of at least one operating parameter of the power system;

(b) a communications channel operable to deliver data indicative of external information to the control system; and (c) a processor coupled to the at least one sensor and the communications channel, the processor programmed to:

(i) identify a plurality of discrete potential dynamic events;

(ii) for each potential dynamic event, compute an optimization profile which describes power settings for the power system to follow in order to optimize at least one operating parameter of the at least one power unit; and (iii) select one of the optimization profiles based on the potential dynamic event with the highest current probability.

16. The control system of claim 15 wherein the processor is further programmed to operate the power system in accordance with the selected optimization profile.

17. The control system of claim 15 wherein the processor which calculates the optimization profiles is located offboard the power system and wherein the optimization profiles are relayed to the power system through the communications channel.

18. The control system of claim 15 wherein each of optimization profiles optimizes a parameter selected from the group consisting of: speed, fuel efficiency, vehicle emissions, vibration, component efficiency, geographic restrictions, and combinations thereof.

19. The control system of claim 15, wherein the power system comprises a railway transportation system, and wherein the power generating unit comprises at least one locomotive powered by at least one internal combustion engine.

20. The control system of claim 15, wherein the power system comprises a marine vessel, and wherein the power unit comprises at least one internal combustion engine.

21. The control system of claim 15, wherein the power system comprises an off-highway vehicle, and wherein the power unit comprises at least one internal combustion engine.

22. The control system of claim 15, wherein the power system comprises an external power unit which provides motive power to move a passive or active vehicle on a guideway.

23. The control system of claim 15, wherein the power system comprises an electrical power generation system.

24. The control system of claim 15 wherein the potential dynamic events are classified as near-horizon events or far-horizon events, and wherein near-horizon events are assigned a higher probability than far-horizon events.

25. The control system of claim 24 wherein the potential dynamic events are classified as near-horizon events or far-horizon events based on their physical distance from the power system.

26. The control system of claim 24 wherein the potential dynamic events are classified as near-horizon events or far-horizon events based on their temporal separation from the power system.

* * * * *